US005388363A

United States Patent [19]

Smart

[11] Patent Number: 5,388,363

[45] Date of Patent: Feb. 14, 1995

[54] LAMINATED GUN STOCK

[76] Inventor: Merlin L. Smart, 134 Zimmerman Rd., Kalispell, Mont. 59901

[21] Appl. No.: 222,163

[22] Filed: Apr. 4, 1994

Related U.S. Application Data

[63] Continuation of Ser. No. 959,434, Oct. 13, 1992, abandoned.

[51] Int. Cl.[6] ..... F41C 23/14

[52] U.S. Cl. ..... 42/71.01

[58] Field of Search ..... 42/71.01, 74, 71.02, 42/75.01, 75.02, 75.03, 75.04

[56] References Cited

U.S. PATENT DOCUMENTS

| | | | |
|---|---|---|---|
| D. 241,836 | 10/1976 | Ruger et al. | 42/71.01 |
| 458,824 | 9/1891 | Daudeteau | 42/71.01 |
| 557,947 | 4/1896 | Bennett | 42/75.01 |
| 1,025,529 | 5/1912 | Johnson | 42/71.01 |
| 1,025,550 | 5/1912 | Tilton | 42/71.01 |
| 1,376,917 | 5/1921 | Bump | 42/71.01 |
| 2,563,923 | 8/1951 | Crosby | 42/71.01 |
| 3,023,527 | 3/1962 | Leek et al. | 42/75.03 |

FOREIGN PATENT DOCUMENTS

| | | | |
|---|---|---|---|
| 923976 | 7/1947 | France | 42/71.01 |
| 925197 | 8/1947 | France | 42/75.02 |

OTHER PUBLICATIONS

Rifle–The Sporting Firearms Journal; Sep./Oct., 1990, #131; pp. 55, 56.

*Primary Examiner*—Stephen M. Johnson
*Attorney, Agent, or Firm*—Wood, Phillips, VanSanten, Clark & Mortimer

[57] ABSTRACT

A laminated rifle stock includes first and second layers cut from a wood blank having growth rings. The second layer is rotated about a longitudinal axis thereof or widthwise with respect to the first layer such that the growth rings of the first layer substantially mirror the growth rings of the second layer.

13 Claims, 3 Drawing Sheets

Fig. 1
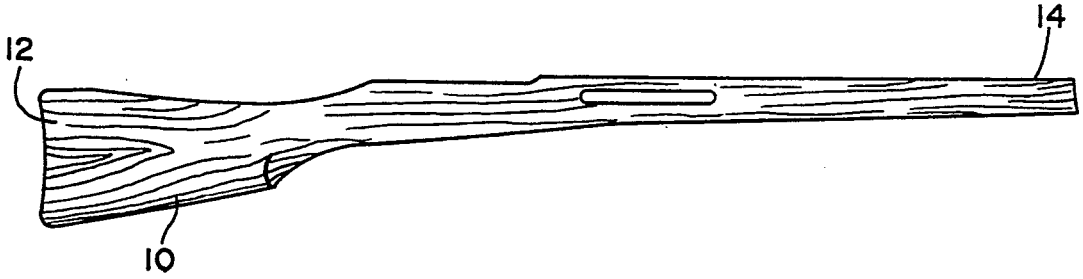
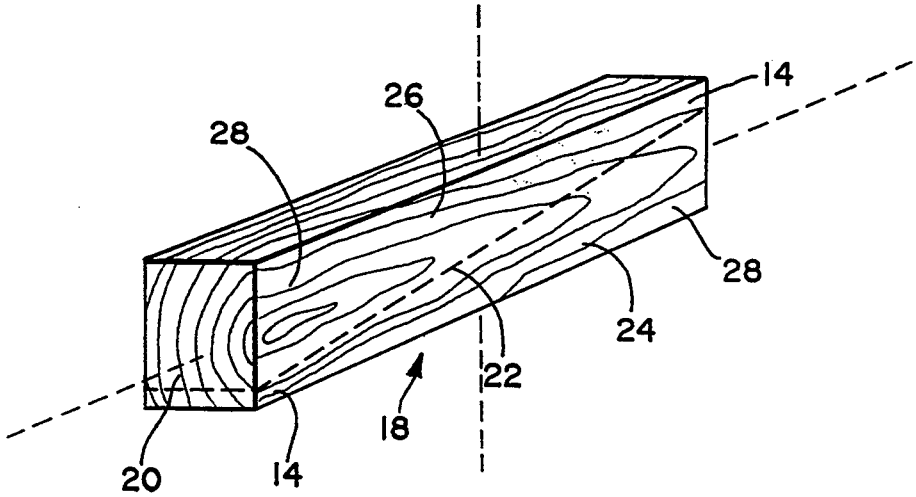
Fig. 2
PRIOR ART

LAMINATED GUN STOCK

This application is a continuation of application Ser. No. 07/959,434 , filed Oct. 13, 1992 now abandoned.

TECHNICAL FIELD

This invention relates to gun stocks, and more particularly to laminated gun stocks.

BACKGROUND ART

Rifle stocks are typically cut from a solid blank of wood having growth rings. These rifle stocks warp in a direction normal to the growth rings when exposed to moisture. Prior art laminated stocks are made from blanks cut lengthwise into multiple layers and then glued together. While laminated stocks offer increased strength over solid stocks, the laminated stocks also experience warpage.

Other prior art laminated stocks include at least one pair of layers with one layer of the pair rotated along a vertical axis thereof or lengthwise (end-to-end) with respect to the other layer. Some warpage of the rotated layer cancels the warpage of the non-rotated layer where the growth rings on the rotated and non-rotated layers mirror each other. However, since the growth rings at a cross section of one end of these laminated blanks are typically different than the growth rings at a cross section of an opposite end of the blank, any cancellation is coincidental.

Warpage occurs as the moisture content in the wood stock varies. A barrel channel of the warping stock puts pressure on the barrel of the rifle and deflects bullets as they pass through the barrel.

Warpage is not noticeable by most hunters due to short shooting distances and large targets. However, the effects of the warpage increases proportionally as the shooting distance increases. In competitive target shooting, the shooting distance is long enough that the effects of warpage are significant.

Sights attached to the rifle are adjusted for accuracy. As warpage varies with the moisture content of the stock, the sight becomes misaligned causing inaccurate shooting. Consequently, the sight must be continually adjusted.

SUMMARY OF THE INVENTION

A laminated rifle stock includes first and second layers cut from a wood blank having growth rings. The second layer is rotated along a longitudinal axis thereof or widthwise with respect to the first layer such that the growth rings of the first layer substantially mirror the growth rings of the second layer.

A further feature of the invention is to provide a layer having neutral growth rings. The first and second layers are bonded to opposite sides of the neutral layer.

A further feature of the invention is to cut third and fourth layers from the blank. The third layer is rotated along a longitudinal axis thereof or widthwise with respect to the fourth layer and bonded to an outer surface of the first layer. The fourth layer is bonded to an outer surface of the second layer. The growth rings of the third layer substantially mirror the growth rings of the fourth layer.

BRIEF DESCRIPTION OF THE DRAWINGS

FIG. 1 is a side view of a rifle stock;

FIG. 2 is a perspective view of a prior art wood blank from which a stock might be cut;

DESCRIPTION OF THE PREFERRED EMBODIMENTS

Figure 3:
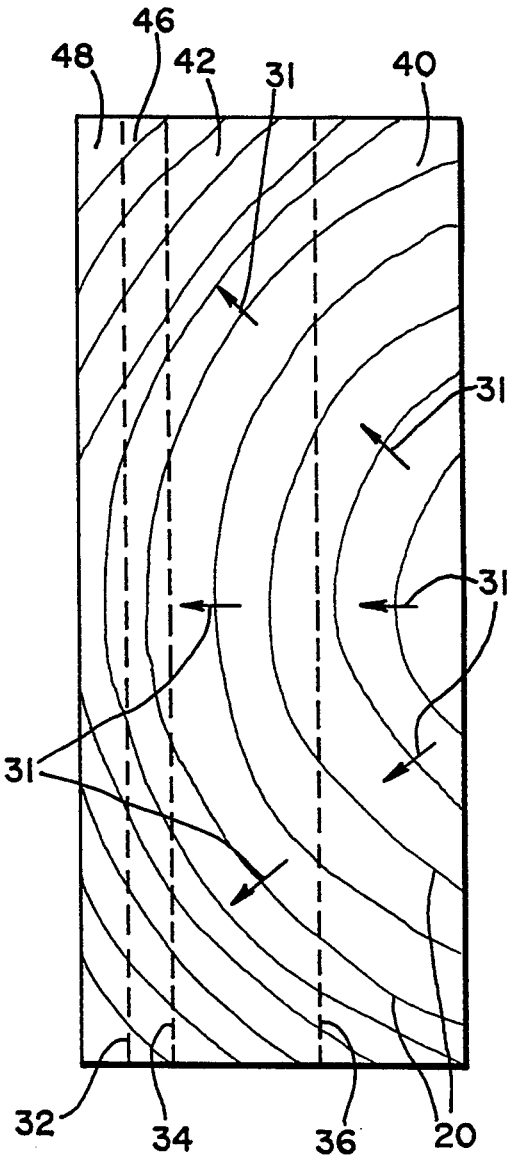
FIG. 3 is an end view of the wood blank of FIG. 2.

In FIG. 1, a stock 10 for a rifle has a butt 12 and a fore end 14 with a barrel channel (not shown). A perspective view of an uncut rectangular blank 18 having concentric growth rings 20 is shown in FIG. 2. According to the prior art, a stockmaker cuts the rectangular blank 18 diagonally along dotted line 22 into first and second blanks 24 and 26 each having a butt end 28 and fore end 14. The stockmaker then cuts each of the first and second blanks 24 and 26 into first and second stocks 10.

For other prior art stocks the stockmaker cuts the solid blank 18 lengthwise into multiple layers and then glues the layers together to form a laminate prior to cutting the solid blank 18 along dotted line 22 into first and second blanks 24 and 26.

However, these prior art stocks 10 have problems with warpage of the barrel channel which puts pressure on the barrel. In FIG. 3, an end view of the uncut stock blank 18 is shown. When subjected to moisture, both solid and laminated rifle stocks warp in a direction indicated by arrows 31, e.g., at a direction normal to the growth rings 20. Pressure on the barrel due to warpage deflects bullets fired from the rifle.

According to the invention, to prevent undesirable warpage from occurring, the un-cut stock blank 18 is cut lengthwise along dotted lines 32, 34, 36 creating four layers before the blank 18 is cut diagonally along the dotted line 22 into two blanks as in FIG. 2. Two layers 40, 42 are of a first thickness and two layers 46, 48 are of a second thickness.

Figure 4:
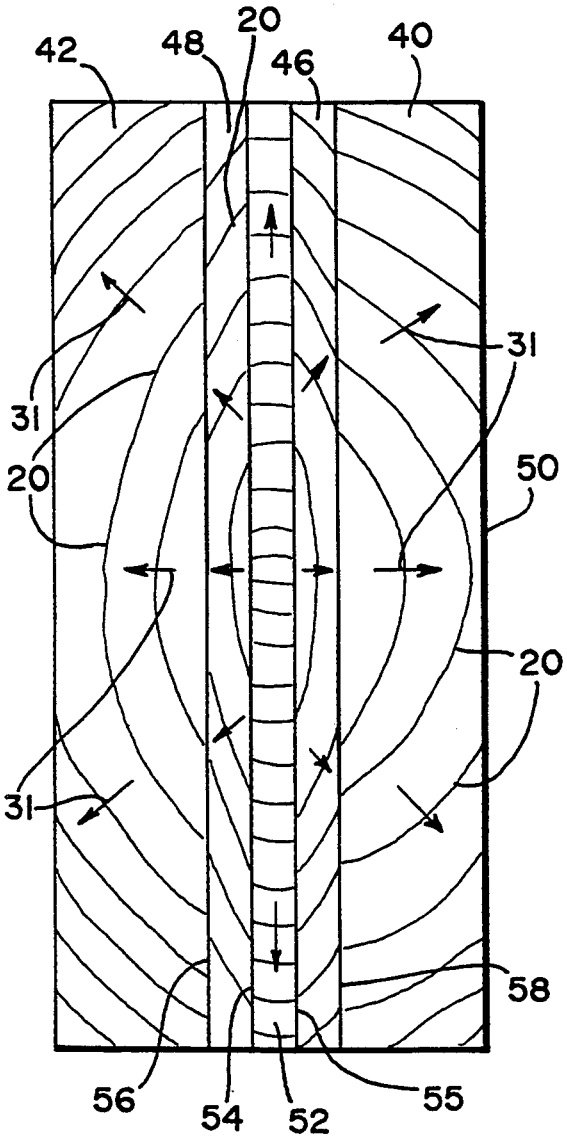
FIG. 4 is an end view, similar to FIG. 3, of a five-layer laminated wood blank for a stock illustrating my invention.

FIG. 4 shows the layers 40, 42, 46, and 48 arranged in a laminate 50 which includes a neutral layer 52 cut from a different blank. The layer 48 is bonded to a side 54 of the neutral layer 52 by a suitable wood bonding glue. The layer 46 is rotated 180° along a longitudinal axis thereof or widthwise and bonded to an opposite side 55 of the neutral layer 52.

The layer 42 is bonded to a side 56 of the layer 48. The layer 40 is rotated 180° along a longitudinal axis thereof or widthwise and bonded to a side 58 of the layer 46. As a result, the growth rings 20 of the layers 42, 48 are an approximate mirror image of the growth rings 20 of the layers 40, 46, respectively which are located opposite the neutral layer 52.

Due to the orientation of the layers 46, 48, the warpage of the layer 46 due to moisture and illustrated by arrows 31 tends to cancel the tangential warpage of the layer 48. Similarly, the warpage of the layer 40 tends to cancel the warpage of the layer 42. The neutral layer 52 provides additional stability but is not required.

As a result of reversal of the growth rings 20 through rotation about a longitudinal axis or widthwise rotation, the barrel is stabilized. As can be appreciated, additional pairs of layers with reversed growth rings 20 will further stabilize the barrel channel.

The layers 40, 46 are rotated 180° about a longitudinal axis thereof or widthwise (top to bottom) and not about a vertical axis or lengthwise (end to end) because the growth rings 20 at a cross section (as in FIG. 3) of the butt end 28 are different from the growth rings 20 of a cross section of the fore end 14. Cancellation due to rotation about a longitudinal axis or widthwise rotation is more uniform as shown by the arrows 31 in FIG. 4.

Figure 5:
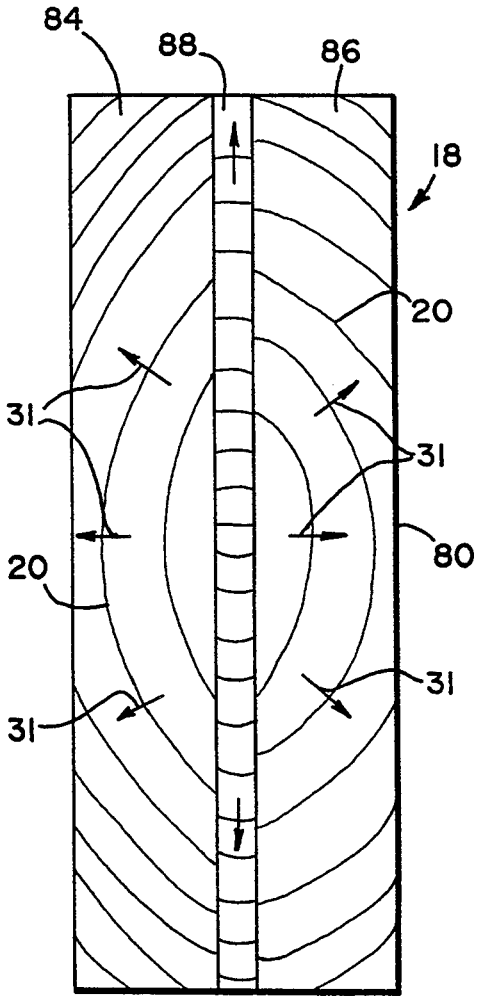
FIG. 5 is an end view, similar to FIG. 3, of a three-layer laminated wood blank.

It can be appreciated that laminates according to the invention must be formed of at least two layers with one of the layers rotated 180° about a longitudinal axis thereof or widthwise after being cut from the blank 18. In FIG. 5, the blank 18 is formed of a second laminate 80 with first and second layers 84, 86 bonded to opposite sides of a neutral layer 88. While the neutral layer 88 provides additional stability to the stock 12, the neutral layer 88 is not required.

Figure 6:
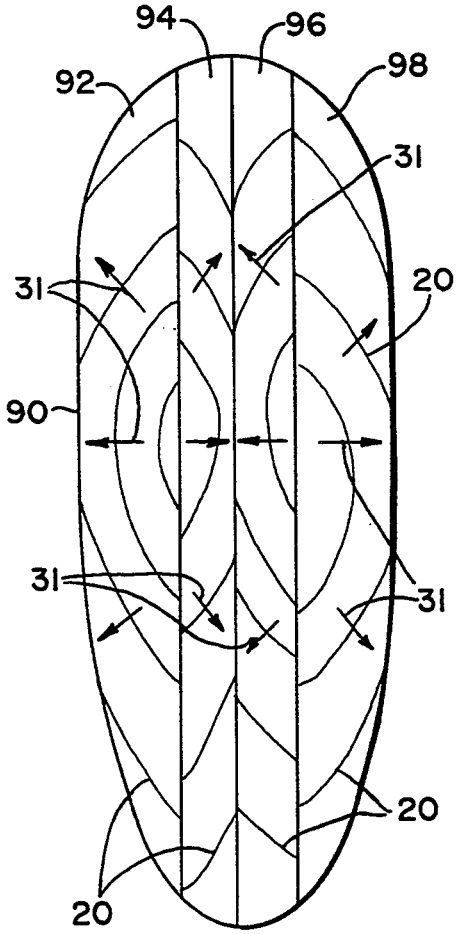
FIG. 6 is an end view from the butt end of a four-layer laminated stock.

In FIG. 6, a cross sectional view of the butt 12 of the stock 10 is shown and is made from a laminate 90 having four layers 92, 94, 96, 98 but no neutral layer. Note that the normal force lines 31 of the growth rings 20 of the layer pairs, for example layers 94, 96, can be directed inwardly towards each other in contrast to the outwardly directed normal force lines 31 of FIGS. 4 and 5.

The foregoing embodiments are illustrative of the broad inventive concepts of the invention.

I claim:

1. A method of making a laminated rifle stock comprising the steps of:

providing an elongate wood blank with lateral growth rings, the blank having a length and spaced ends;

cutting first and second layers from the blank each layer extending the length of the blank;

rotating the first layer about its longitudinal axis with respect to the second layer; and bonding the rotated first layer to the second layer such that the first and second layers have substantially the same end-to-end alignment as the first and second layers had as part of the wood blank from which the first and second layers were cut and growth tings on the first layer substantially mirror growth rings on the second layer.

2. The method of claim 1 wherein the first and second layers adjoin each other as part of the blank and after said cutting and rotating steps are bonded together by bonding a face of the first layer which adjoined the second layer before the layers were cut from the blank to a face of the second layer which did not adjoin the first layer as part of the blank.

3. The method of claim 1 including the step of bonding a layer with neutral grain between the first and second layers.

4. The method of claim 1 including the steps of cutting third and fourth layers from the blank each layer extending the length of the blank, rotating the third layer about its longitudinal axis with respect to the fourth layer, and after rotating the first layer relative to the second layer bonding the rotated third layer and the fourth layer to outer oppositely-directed faces of the rotated first layer and second layer, respectively, such that the third and fourth layers have substantially the same end-to-end alignment as the third and fourth layers had as part of the wood blank from which the third and fourth layers were cut and growth rings on the third layer substantially mirror growth tings on the fourth layer.

5. The method of claim 4 including the step of bonding a layer with neutral grain between the first and second layers.

6. A laminated rifle stock produced according to the method of claim 1.

7. A laminated rifle stock comprising:

first and second layers cut from an elongate wood blank with lateral growth rings, said wood blank having a length thereof, spaced ends and grain running in one direction along the length between said ends, wherein said first layer is rotated about its longitudinal axis relative to the second layer such that growth tings of the first layer are a substantial mirror image of growth rings of the second layer; and an adhesive bonding said layers together to produce a laminated rifle stock having grain running in one direction and said substantial mirror image growth rings in the two layers.

8. The laminated rifle stock of claim 7 wherein said first and second layers adjoin each other before they are cut from said wood blank and a face of said first layer which adjoined said second layer as part of said wood blank is bonded by said adhesive to a face of said second layer which did not adjoin said first layer as part of said wood blank.

9. The laminated rifle stock of claim 8 wherein said first and second layers each have two oppositely directed faces thereof such that a face of the first layer and a face of the second layer adjoin each other as part of said wood blank and the other faces of the first and second layers are in non-adjoining relation to each other as part of said wood blank, and said adhesive bonds said adjoining face of said first layer and said non-adjoining face of said second layer as part of said laminated rifle stock.

10. The laminated rifle stock of claim 7 further including a layer with neutral grains bonded between said first and second layers.

11. The laminated rifle stock of claim 7 further including third and fourth layers cut from said blank, said third layer being rotated about its longitudinal axis relative to said fourth layer such that growth tings of said third layer are a substantial mirror image of growth rings of said fourth layer and said third and fourth layers have substantially the same end-to-end alignment as said third and fourth layers had as part of said wood blank from which said third and fourth layers were cut, and said third layer and said fourth layer being bonded to outer-oppositely-directed faces of said rotated first layer and said second layer, respectively, to produce a laminated rifle stock having grain running in one direction and said substantial mirror image growth rings in said first and second layers and said third and fourth layers, respectively.

12. The laminated rifle stock of claim 11 further including a layer with neutral grains bonded between said first and second layers.

13. A method of making a laminated rifle stock comprising the steps of:

providing a wood blank having growth rings;

cutting the blank lengthwise into first and second layers;

rotating said first layer about a longitudinal axis thereof;

bonding said first and second layers relative to one another so that the growth rings on said first layer substantially mirror the growth rings on said second layer;

providing a neutral layer;

bonding said neutral layer between said first and second layers; and cutting said stock from said bonded layers.

* * * * *